US008632480B2

(12) United States Patent
Gardner et al.

(10) Patent No.: US 8,632,480 B2
(45) Date of Patent: Jan. 21, 2014

(54) ORTHOPAEDIC DEVICE

(75) Inventors: Andrew David Gardner, Malvern (GB); Petrus Van De Walt, Barnstaple (GB)

(73) Assignee: The Malvern Orthopaedic Company Ltd., Malvern, Worcestershire (GB)

( * ) Notice: Subject to any disclaimer, the term of this patent is extended or adjusted under 35 U.S.C. 154(b) by 541 days.

(21) Appl. No.: 12/921,303

(22) PCT Filed: Mar. 6, 2009

(86) PCT No.: PCT/GB2009/050228

§ 371 (c)(1),
(2), (4) Date: Dec. 2, 2010

(87) PCT Pub. No.: WO2009/109789

PCT Pub. Date: Sep. 11, 2009

(65) Prior Publication Data

US 2011/0105965 A1 May 5, 2011

(30) Foreign Application Priority Data

Mar. 7, 2008 (GB) ..... 0804343.2

(51) Int. Cl.
*A61H 1/02* (2006.01)

(52) U.S. Cl.
USPC ..... 601/27; 601/23; 601/33; 601/34

(58) Field of Classification Search
USPC ..... 5/651; 128/882; 446/206, 236–266; 482/51, 79, 95–96, 112, 131–135, 139; 601/5, 23, 27, 29–36; 602/16, 23, 35, 602/36, 5
See application file for complete search history.

(56) References Cited

U.S. PATENT DOCUMENTS

| | | | | | |
|---|---|---|---|---|---|
| 4,255 | A | * | 11/1845 | Mills et al. | 602/16 |
| 653,179 | A | * | 7/1900 | Hughes | 602/23 |
| 1,606,933 | A | * | 11/1926 | Fowler | 602/5 |
| 1,904,942 | A | * | 4/1933 | Heigl | 602/35 |
| 2,408,597 | A | | 10/1946 | Belling | |
| 3,750,329 | A | * | 8/1973 | Zbikowski et al. | 446/237 |
| 4,214,577 | A | * | 7/1980 | Hoy | 601/33 |
| 4,229,001 | A | | 10/1980 | Roman | |
| 4,323,060 | A | * | 4/1982 | Pecheux | 602/33 |
| 4,665,899 | A | * | 5/1987 | Farris et al. | 601/33 |
| 4,784,121 | A | * | 11/1988 | Brooks | 601/34 |
| 4,930,497 | A | * | 6/1990 | Saringer | 601/34 |
| 5,279,530 | A | * | 1/1994 | Hess | 482/70 |
| 5,333,604 | A | * | 8/1994 | Green et al. | 601/33 |

(Continued)

FOREIGN PATENT DOCUMENTS

| | | | |
|---|---|---|---|
| GB | 2360945 | A1 | 11/2010 |
| JP | 11319145 | A1 | 11/1999 |

*Primary Examiner* — Loan Thanh
*Assistant Examiner* — Rae Fischer
(74) *Attorney, Agent, or Firm* — Fraser Clemens Martin & Miller LLC; J. Douglas Miller

(57) ABSTRACT

A jointexercising device suitable for both lying and sitting patients comprises a tubular frame (11) having an inclined surface (20, 21), and a leg support (31) movable on the surface via an axle (39) and wheels (40). The support is attachable to the axle either via foot portion (33) or leg portion (32), and in either orientation. The inclination of the frame (11) is adjustable. Fences (51) allow leg lifting exercises without disengagement of the wheels (40).

10 Claims, 5 Drawing Sheets

(56) References Cited

U.S. PATENT DOCUMENTS 5,399,147 A * 3/1995 Kaiser ..... 601/34
5,484,154 A * 1/1996 Ward ..... 280/652
6,962,570 B2 * 11/2005 Callanan et al. ..... 601/5
7,282,035 B2 * 10/2007 Huang ..... 601/5
2006/0064044 A1 * 3/2006 Schmehl ..... 601/34
2006/0211957 A1 9/2006 Beny et al.

* cited by examiner

ORTHOPAEDIC DEVICE

The present invention relates to an orthopaedic device, and in particular a device for exercising a knee and/or hip joint following injury, neurological damage or surgery.

Knee and hip surgery is quite common, ranging from day case surgery such as arthroscopy to full knee or hip replacement. It is known that rapid introduction of physiotherapy, in particular knee joint movement, is critical in ensuring a full recovery of the action of a joint. Active exercise, in which the joint and controlling muscles are fully functioning, is more beneficial than passive movement. This is also the case following a stroke or head injury where there is neurological damage.

It is not always advisable, possible, nor physiologically recommended, to proceed immediately to exercise which bears full body weight. A low input, load bearing exercise regime may be particularly important in increasing patient confidence whilst allowing articulation of the joint through the full range of movement. In addition swelling and deep vein thrombosis are not infrequent complications; effective elevation of the lower limb combined with muscle use aids venous return that minimizes such complications.

GB-A-2360945 discloses a knee exercising machine having a frame with inclined rails, upon which a supporting carriage for a leg can be moved by a patient against the effect of gravity. The machine permits variation of the inclination and of leg position so as to vary the patients work input whilst lying down, and is useful in encouraging the patient to exercise the knee whilst in bed.

In a first aspect, the present invention provides a device for active exercise of a joint and comprising a support adapted to receive the lower leg and foot of a patient, a frame having an inclined surface, and a carriage permitting movement of the support on said inclined surface, said support comprising a foot supporting surface substantially orthogonal to a lower leg supporting surface, said leg and lower foot supporting surfaces being adapted for alternative mutually substantially orthogonal support by said carriage.

Such an arrangement permits the device to be used whilst lying down, with the lower leg substantially horizontal, and whilst sitting. A preferred angle between the supporting surfaces is about 100°.

In a preferred embodiment, the carriage is alternately attachable to the lower leg supporting surface and to the foot supporting surface.

In this specification, by 'lower leg' we mean that portion of the leg which extends below the knee.

The carriage may comprise an axle adapted for engagement in a respective location recess of the lower leg supporting surface and of the foot supporting surface, and may be snap-fitting.

In a preferred embodiment the support is a one-piece plastics moulding, and the axle is a round bar for snap-fitting engagement therewith.

In a second aspect, the invention comprises a one-piece support adapted to receive the lower leg and foot of a patient, and a movable support portion whereby the support length of the lower leg may be adjusted.

Typically the invention provides for a support adapted to receive the lower portion of the lower leg, and a movable support portion for engagement with the upper portion of the lower leg. The movable support portion is preferably slidably engaged with said support, and together the components comprise co-planar leg supporting surfaces.

The support portion may comprise one of several attachable components having different lengths of legs supporting surface.

Such arrangements allow adjustment to suit leg length of the patient, so that for example one such support together with a selectable or adjustable support portion is adaptable to a large proportion of the population.

In a preferred embodiment the support portion and support include mutually engageable peg and slot fittings to confine relative movement to the direction of the leg axis. A plurality of spaced pegs and respective slots may be provided to promote lateral stability. In the preferred embodiment three spaced pegs of the support portion engage within three spaced slots of the support.

Both support portions and support preferably are adapted for engagement with the underside of the leg, and may further include apertures for receiving leg retaining straps. The foot supporting portion of the support may also include such apertures. Typically the restraining straps comprise strips of material having suitable adjustable tightening means, for example hook and loop fasteners.

In use the position of the support portion may be adjusted longitudinally to give comfortable support to the lower leg, and is retained by a suitably tightened strap. Alternatively a support portion of suitable size is fully engaged with the support to give a continuous support surface over the desired leg length.

A support pad, which may be single use or washable, may be provided for the leg supporting surfaces of the support and support portion, and in several sizes to suit the range of intended use. Attachment straps for the support and support portion may also be disposable. Such straps may also include comfort padding.

In a third aspect of the invention an inclined frame of a knee exercising device has two laterally spaced support surfaces for a carriage movable thereon, said carriage comprising an axle having two wheels respectively engageable with said support surfaces, and said wheels being of PTFE or other suitable low friction material.

Wheels of low friction material have the advantage that both the internal bearing surface for the axle, and the external bearing surface for the support surfaces are of low friction material, and this obviates the use of complex bearings, in particular relatively heavy metal ball bearings.

The axle is preferably cranked so that the wheel axis is spaced from the support engaging axis, but parallel thereto. Such an arrangement ensures that the support hangs from the wheels and provides stability for the leg whilst maintaining contact between the wheels and the support surfaces thereof, and giving a degree of self-centring. Furthermore should wheels make contact with an end stop, the axle will rotate and slow motion of the cradle gradually; this avoids any jar or shock to the joint. Furthermore a rotation of the axle permits a straight leg raise at any point in the travel path of the cradle.

In the preferred embodiment the wheels have female form for example a continuous groove, and are engageable with a male form support surface, for example a tube. Alternatively the wheels may engage in a 'C' shaped groove of an extruded rail.

In a fourth aspect, the invention comprises a frame of knee exercising device, said frame comprising two horizontal ground engaging base portions, four upright portions extending respectively from either end of said base portions, and two parallel inclined portions linking said upright portions, the frame thus constituted as a continuous member of preferably substantially constant section.

One base portion and associated upright parts thereof may be slidable with respect to respective upright parts of said inclined portions, so as to allow height adjustment. Typically a slightly larger gauge section permits relative telescopic movement, and a suitable latch arrangement engages the upright parts to give selectable lengths of upright portion.

Preferably the frame is tubular, but could also comprise a continuous extruded section of suitable shape.

Tubular inclined portions are inherently adapted to receive pulley-like wheels of a carriage for movement and lateral location thereof. A 'C' section frame allows wheels to be confined against vertical movement.

In a fifth aspect of the invention, a frame of a knee exercising device defines inclined support surfaces adapted to receive wheels of a carriage thereon, each support surface having a fence to prevent substantial disengagement of said wheels. The fence permits use of the device for exercise which tend to lift the carriage from the frame, in addition to the more usual exercise in which weight is applied to the carriage. The fence may be an attachable component, or integral or integrated with the inclined surface.

The support surfaces preferably have one of a male and female form, and the wheels have the other of a male and female form so as to give lateral stability, said fence ensuring substantial engagement of said forms at all times. Thus said wheels remain laterally engaged with the respective support surfaces when the support surfaces are not directly load bearing.

In one preferred embodiment the support surfaces comprise tubular rails, and have respective fences comprising 'C' shaped members extending in use under said rails and over said wheels. Each fence may comprise an one-piece plastic moulding adapted for snap-fitting to a respective rail. Alternatively the support surfaces may comprise 'C' section rails within which said wheels are confined.

Other features of the invention will be apparent from the following description of a preferred embodiment, illustrated by way of example only in the accompanying drawings, in which:—

Figure 1:
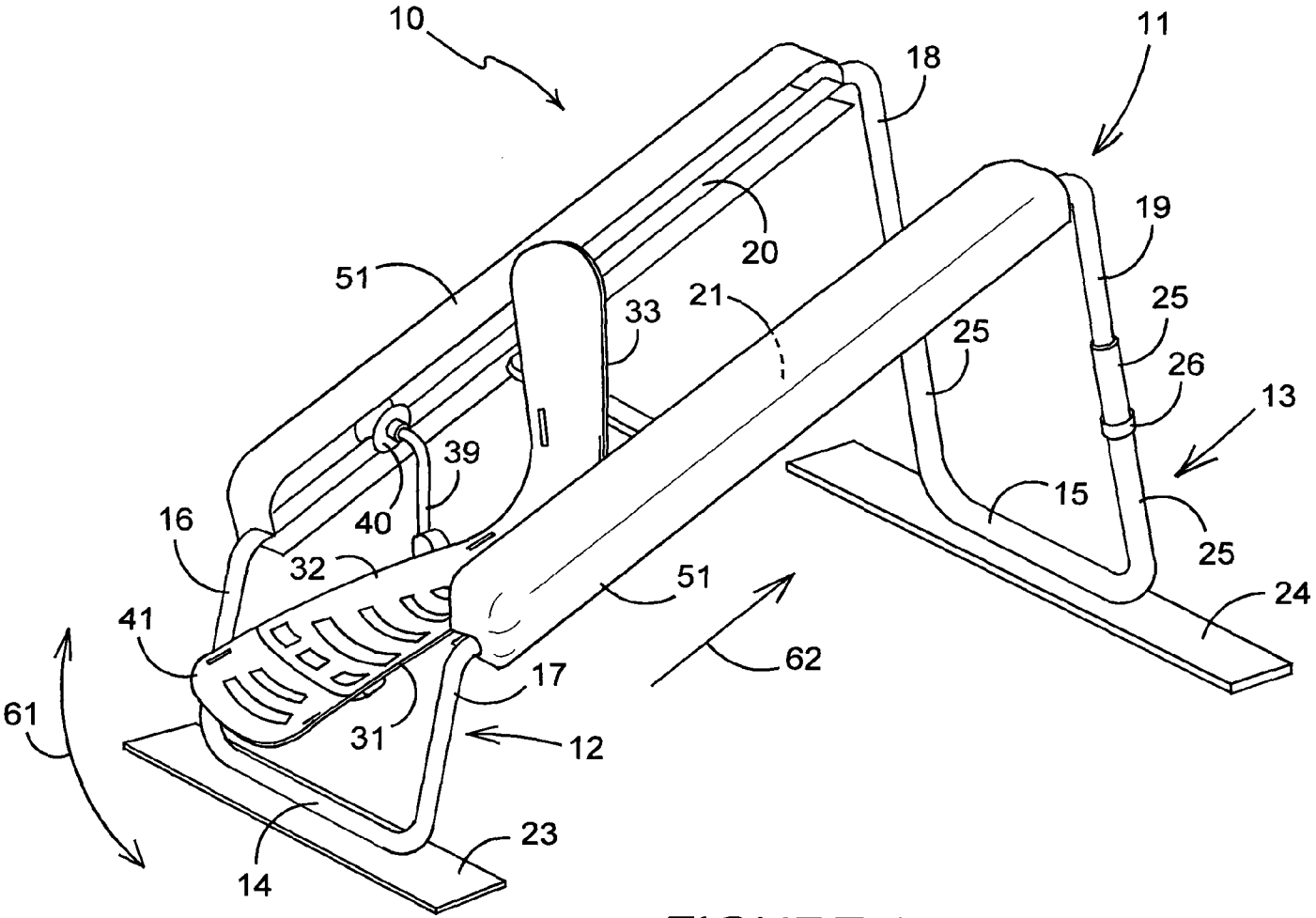
FIG. 1 is a perspective view of a lower limb exerciser according to aspects of the present invention.

With reference to FIG. 1, a lower limb exerciser 10 comprises a tubular frame 11 having a proximal part 12 and a distal part 13. The distal part 13 is of slightly larger bore, and receives the proximal part 12 in telescopic sliding engagement, in a manner to be explained.

The frame is symmetrical, longitudinally continuous and comprise two ground bearing base portions 14,15, four substantially upright portions 16-19 linked by parallel inclined portions 20,21.

Floor pads 23,24 provide an anti-slip surface, and may be attached to the base portions if desired. The pads may be attached by suitable snap-fit formations and be self-aligning by virtue of the tubular frame, so as to accommodate variations in bed or floor profile. Suitable locking arrangements may latch the pads 23,24 at a desired orientation, for example by means of a spring loaded plunger engaging a corresponding hole in the tubular frame.

The telescopic portions at the distal side permit the length of the upright portions 18,19 to be selected, a series of holes 25 being provided through the outer tube for register with a respective hole of the inner tube. A clip 26 of any suitable kind is provided for each upright portion (one only is shown) so as to project through aligned holes and thus lock the portions 18,19 at the desired extension.

Figure 2:
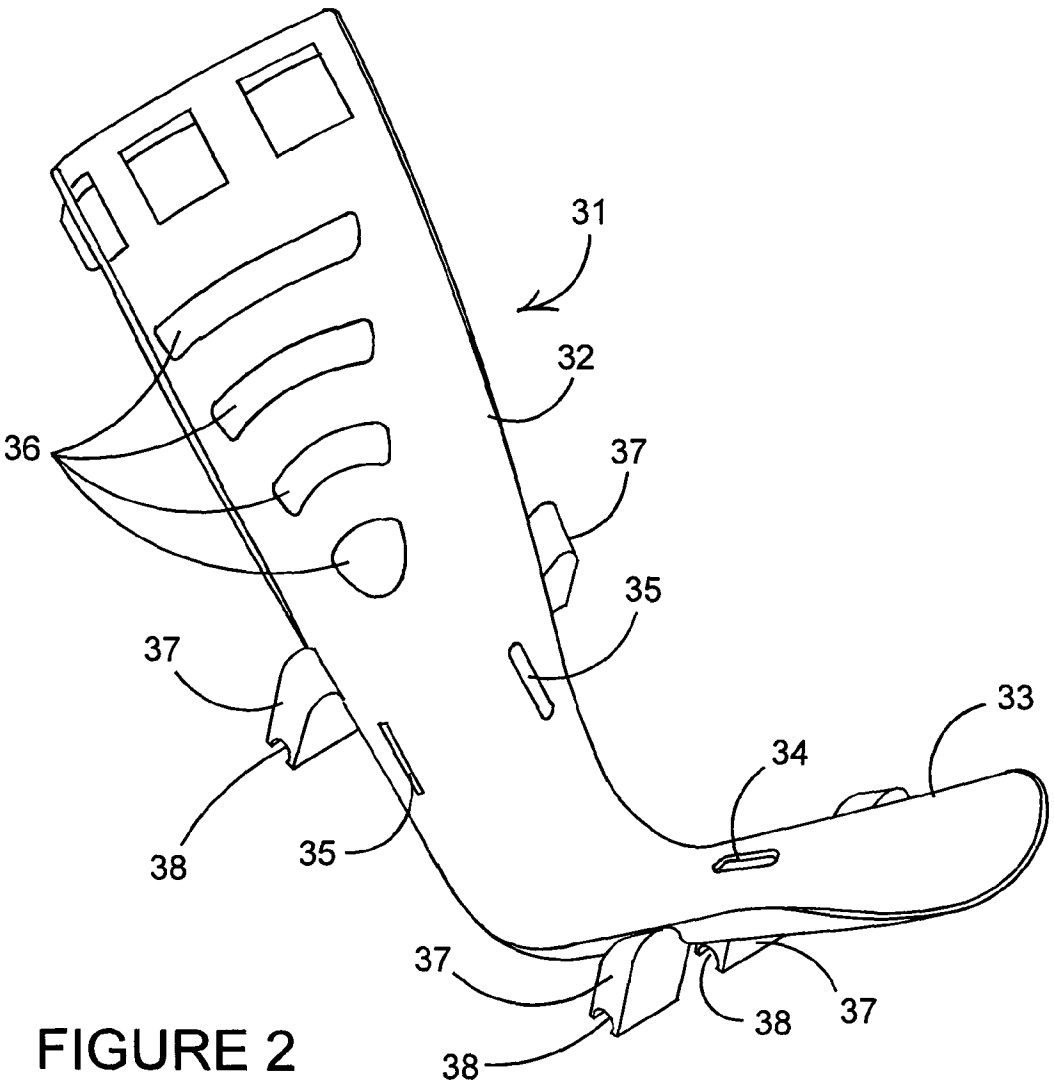
FIG. 2 is a support for the lower leg and foot.

With reference to FIG. 2, a one-piece arcuate support 31 of e.g. polypropylene is adapted to support the lower leg and foot from below. The lower leg portion 32 is substantially at right angles to the foot portion 33. Suitable apertures 34 receive restraining straps in use, so as to hold the leg and foot on the support. Air flow apertures 35 allow cooling of the lower leg, and may also be provided in the foot portion.

The underside of both the foot portion and lower leg portion is provided with an axle support comprising respective pairs of projections 37 having recesses 38 for snap-fitting of a cylindrical cranked axle 39 (FIG. 1). The axle 39 may fit to either pair of projection 37, and the support 31 may be attached to the axle 39 so as to face in one of two directions, thus giving four attachment possibilities. The axle ends are fitted with channel section wheels 40 of PTFE, or other low friction material for engagement with the inclined frame portions 20,21. The inclined frame portions may be polished to reduce friction thereof.

Figure 3:
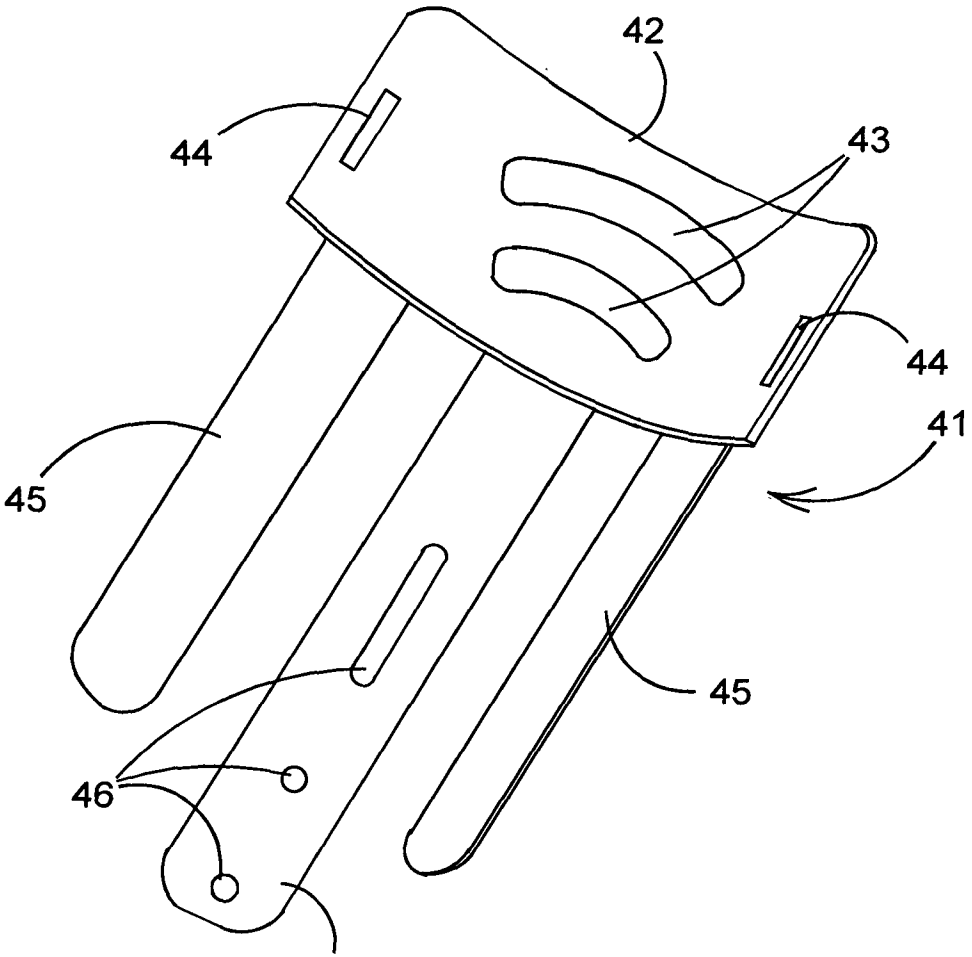
FIG. 3 is a support portion for the upper part of the lower leg.
Figure 4:
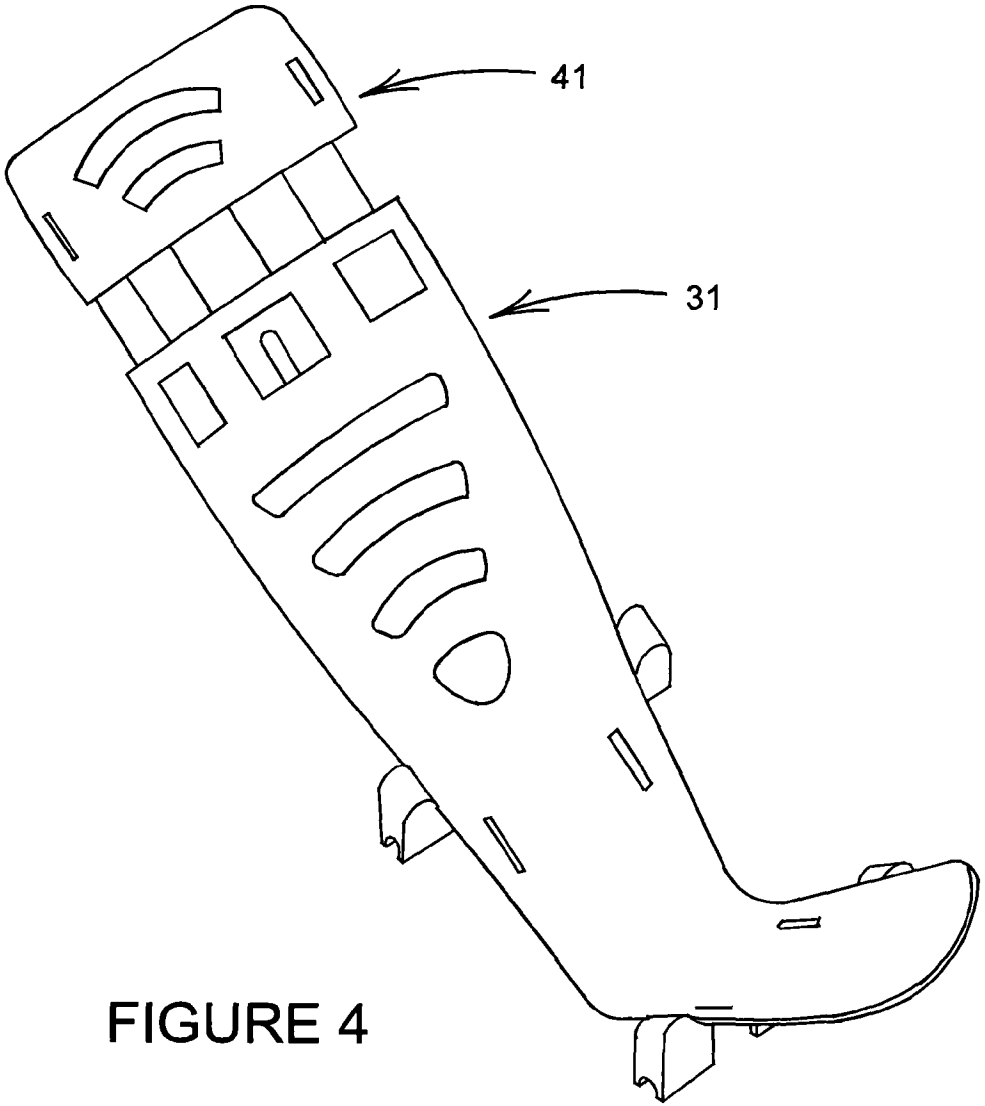
FIG. 4 illustrates the support and support portion in combination.

FIG. 3 illustrates a movable support portion 41 for use with the support of FIG. 2, and FIG. 4 illustrates the support 31 and support portion 41 in combination.

The support portion 41 comprises an arcuate support surface 42 for the upper portion of the lower leg, having ventilation apertures 43 and apertures 44 for suitable restraining straps (not shown). Three arcuate legs 45 project from the support surface for engagement in pockets 36 provided in the rear side of the support 31, as illustrated in FIG. 4.

One or more of the legs 45 may be provided with suitable projections or holes 46 engageable with complementary surfaces of the pockets 36 in order to restrain or lock the support 31 and support portion 41 at a desired extension. In use the support 31 is attached to a patient's leg, and the support portion 41 is extended to give comfortable support over substantially the full lower leg length.

Alternatively several different support portions 41 are provided, each having a different length of supporting surface on the leg axis—a suitable length is selected to give continuous support over the desired length of leg.

Figure 5:
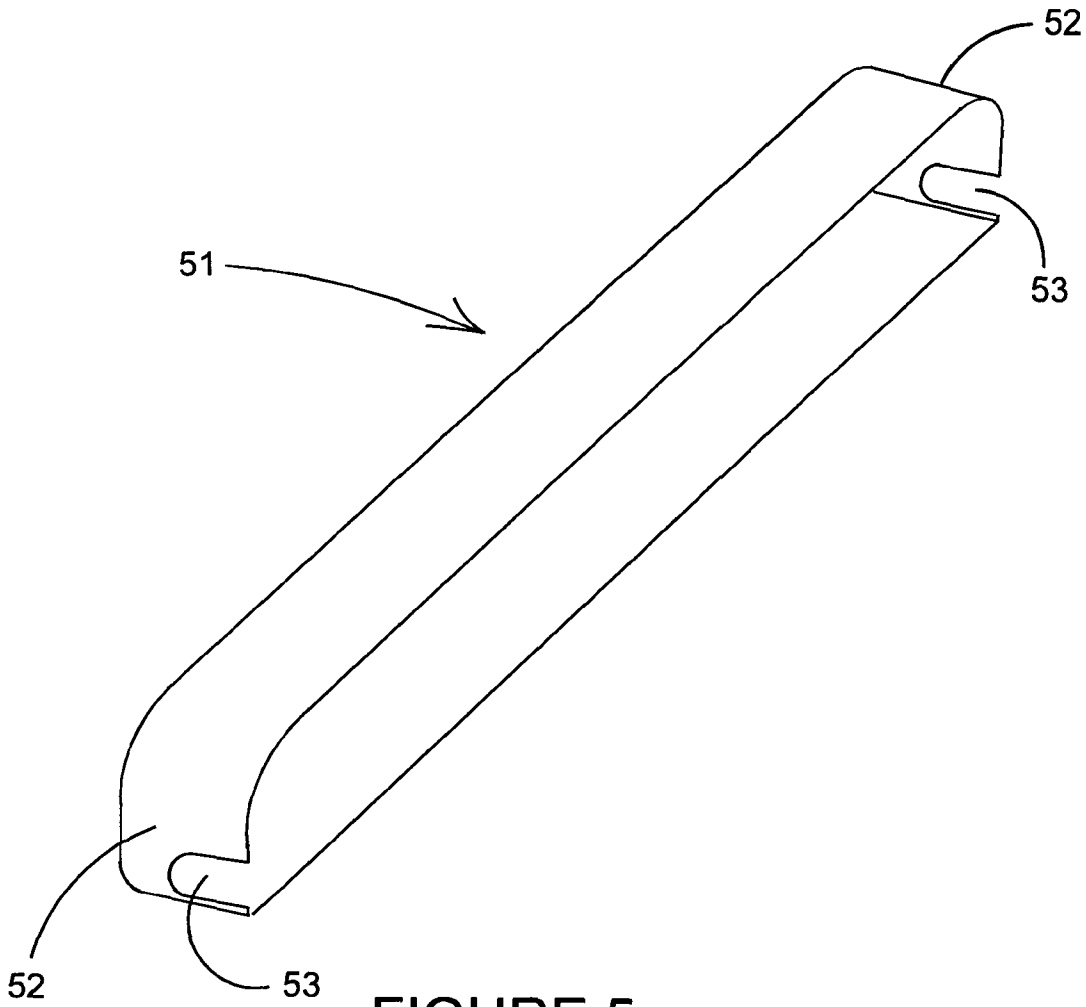
FIG. 5 illustrates a fence for the frame of the lower limb exerciser.

FIG. 5 illustrates a fence 51 for attachment to the parallel inclined portions 20,21 of the frame 11. The fence is symmetrical and thus attachable to either side, and comprises a 'C' section plastic mouldings, with integral end plates 52 defining slots 53 for engagement over the frame portions 20,21 at either respective end. Any suitable means of retention may be used, for example snap-fitting formations immediately adjacent the slots 53.

The components of the lower limb exerciser are assembled, as illustrated in FIG. 1. The wheels 40 engage on the inclined frame portions 20,21, and permit back and forth rolling within travel limits determined by the end plates 52 of the faces 51. End stops (not shown) for the rollers may be adjustable, and fixed relative to the frame by any suitable means, for example peg and slot, or screw thread. The axle 39 is mounted to the support 31, as illustrated, and hangs down so as to give lateral stability, and maintain the wheels in engagement with the corresponding frame portions. The support is free to articulate about the axle, as indicated by double headed arrow 61. In the arrangement illustrated, the leg portion 32 is articulated to the axle 39, and the support portion 41 is pushed fully inwardly. This arrangement is suitable for a patient lying down whereby the leg to be exercised is strapped to the support 31, and the patient tries to straighten the knee whilst pushing the support up the incline of the frame in the direction of arrow 62.

Alternatively, the support 31 can be attached to the axle 39 at the foot portion 33, so that the same exercise can be performed whilst sitting.

The inclination of the frame is adjusted according to the effort required of the patient, and the position of the frame on the floor may be selected in order to encourage a desired stroke. Inclination may be increased over time as knee and or hip function improves. Weights may be added to the support in order to increase the effort required of a patient. A counter may be included to record the number of repetitions performed, and may be position to ensure activation at the desired maximum stroke.

It will be appreciated that the device is simple, intuitive to operate and adaptable to different leg lengths and exercise regimes. It can be used for both lying and sitting patients, and is light enough to be easily transported and lifted on and off a bed. Typically the tubular frame is of aluminium or stainless steel, and the other major components moulded from a suitable plastic such as polypropylene. The axle is typically of stainless steel, and the wheels most preferably of PTFE.

The frame of the preferred embodiment is tubular and includes a fence to avoid wheel lift-off in leg raising exercise. An extruded 'C' section frame of e.g. aluminium allows the inclined surface and fence to be integrated, and is also suitable for forming the base portions and legs of the frame.

In slightly modified forms of the invention, beneficially an adjustable stop can be located at the lower or proximal ends of one or each of inclined parts 20 and 21. That is, positioned between the lower end of the fence or guard 51 and the wheel 40 so as to limit the lowermost extent of movement of the wheel 40 and hence the extent of flexion of a patient's knee. A suitable adjustable stop might comprise an annulus or washer, or part washer for engaging the tube forming inclined part 20 and or 21, and a thumb screw engagable in a threaded aperture in the annulus so as to enable clamping of the stop adjustably along the inclined parts 20 and 21. Additionally, a scale and or movable slider can be provided to indicate the extent of movement by the patient. In one form the scale is preferably located on the upper surface of the guard or fence 51 on one or both sides of the lower limb exerciser 10. Beneficially the scale can be a simple indicator marked on the surface such as a graded scale from 1 to 100 with gradations every unit and or every five units between the lower and upper ends. Moreover, a slidable marker can be provided which marker can frictionally engage the fence 51 and be configured so as to move along the fence 51 along the scale in accordance with movement during exercise, and in one form at least the slidable marker might indicate the maximum extend of movement during a set of repetitions so as to incentivise the patient to seek to improve flexion during a series of exercises. In another form the marker may be attached to the foot portion 33 and move entirely in dependence with the movement of the foot portion 33.

The invention claimed is:

1. A joint exerciser to be used by a patient while sitting and while lying down, comprising:

a support adapted to receive the lower leg and foot of the patient;

a frame having an incline and a carriage permitting movement of the support on the incline, the carriage pivotably connected to an axle, and the frame configured to allow movement of the support parallel to a longitudinal axis of one of the lower leg and foot of the patient;

the support comprising a supporting surface for the foot and a supporting surface for the lower leg that is substantially perpendicular to said supporting surface for the foot, wherein said supporting surface for the foot and said supporting surface for the lower leg are independently configured to be supported by said carriage by attachment to a sole of said supporting surface for the foot and attachment to an underside of said supporting surface for the lower leg, said supporting surface for the foot supported by said carriage when the patient is sitting and said supporting surface for the lower leg supported by said carriage when the patient is lying down.

2. An exerciser according to claim 1 wherein said carriage comprises an axle adapted for snap-fitting engagement with a supporting surface.

3. An exerciser according to claim 1 wherein said incline comprises spaced parallel tubes, and said carriage comprises rolling elements having grooves engageable with and guided by said tubes.

4. An exerciser according to claim 3 wherein said carriage comprises a symmetrical cranked axle having wheels at the ends thereof.

5. An exerciser according to claim 1 wherein said frame comprises a continuous cranked tube.

6. An exerciser according to claim 1 wherein said frame comprises telescope tubular members, and said incline is adjustable by relative movement of said members.

7. An exerciser according to claim 1 wherein the supporting surface for the lower leg comprises a lower portion for supporting the lower portion of the lower leg and an upper portion for supporting the upper portion of the lower leg, the upper portion and lower portion being attached for relative sliding movement in the length direction of the leg.

8. An exerciser according to claim 7 wherein said upper portion includes a plurality of forks engageable in respective close fitting recesses of said lower portion.

9. An exerciser according to claim 1 and further including a fence attachable to said frame and defining travel stops for said carriage.

10. An exerciser according to claim 9 wherein said fence surrounds said carriage sufficiently to prevent disengagement from said incline.

* * * * *